US010233577B2

(12) United States Patent
Demarest et al.

(10) Patent No.: US 10,233,577 B2
(45) Date of Patent: Mar. 19, 2019

(54) RESILIENT BAND FOR ARTICLE OF APPAREL

(71) Applicant: NIKE, Inc., Beaverton, OR (US)

(72) Inventors: Nathan Demarest, Portland, OR (US); Travis Harvey, Portland, OR (US)

(73) Assignee: NIKE, Inc., Beaverton, OR (US)

( * ) Notice: Subject to any disclaimer, the term of this patent is extended or adjusted under 35 U.S.C. 154(b) by 0 days.

(21) Appl. No.: 15/652,838

(22) Filed: Jul. 18, 2017

(65) Prior Publication Data

US 2017/0314176 A1 Nov. 2, 2017

Related U.S. Application Data

(60) Continuation of application No. 13/965,770, filed on Aug. 13, 2013, now Pat. No. 9,738,999, which is a (Continued)

(51) Int. Cl.

| | |
|---|---|
| ***D05B 27/00*** | (2006.01) |
| ***A41D 27/24*** | (2006.01) |
| ***A41F 9/00*** | (2006.01) |
| ***A41F 9/02*** | (2006.01) |
| *A41B 9/14* | (2006.01) |

(52) U.S. Cl.

CPC ..... *D05B 27/00* (2013.01); *A41D 27/24* (2013.01); *A41F 9/00* (2013.01); *A41F 9/025* (2013.01); *A41B 9/14* (2013.01); *A41B 2300/33* (2013.01); *A41D 2300/33* (2013.01); *D05D 2209/08* (2013.01)

(58) Field of Classification Search

CPC ..... A41D 1/06; A41D 2300/33; A41D 2300/332; A41D 27/24; A41F 9/00; A41F 9/025; A41B 9/14; A41B 2300/33; A41B 2300/332; D05B 27/00; D05B 27/08; D05D 2209/08

See application file for complete search history.

(56) References Cited

U.S. PATENT DOCUMENTS

| | | | |
|---|---|---|---|
| 175,439 | A | 3/1876 | Eageb |
| 1,291,048 | A | 1/1919 | McKevitt et al. |

(Continued)

FOREIGN PATENT DOCUMENTS

| | | | |
|---|---|---|---|
| FR | 2590600 | A1 | 5/1987 |
| GB | 866963 | A | 5/1961 |

(Continued)

OTHER PUBLICATIONS

Extended Search Report dated Nov. 11, 2015 in European Patent Application No. 15181176.7, 10 pages.

(Continued)

*Primary Examiner* — Ismael Izaguirre

(74) *Attorney, Agent, or Firm* — Shook, Hardy & Bacon L.L.P.

(57) ABSTRACT

A resilient band for an article of apparel, formed with a first fabric secured to another more resilient fabric. The first and second fabrics are secured together by a plurality of fastening structures extending transversely to a longitudinal length of the resilient band. The first fabric presents a plurality of pleats, where a pleat in the plurality of pleats is defined by an adjacent pair of fastening structures in the plurality of fastening structures.

20 Claims, 3 Drawing Sheets

Related U.S. Application Data division of application No. 12/433,878, filed on Apr. 30, 2009, now Pat. No. 8,555,419.

(56) References Cited

U.S. PATENT DOCUMENTS

| | | | | | |
|---|---|---|---|---|---|
| 1,672,017 | A | * | 6/1928 | Wright | A41F 9/02 2/237 |
| 1,729,265 | A | | 9/1929 | Sinclair et al. | |
| 1,789,823 | A | | 1/1931 | Lehman et al. | |
| 1,873,583 | A | | 8/1932 | Hargreaves et al. | |
| 1,951,450 | A | | 3/1934 | Sochel et al. | |
| 2,113,201 | A | | 4/1938 | Scheitlin et al. | |
| 2,183,257 | A | | 12/1939 | Hardie et al. | |
| 2,277,227 | A | | 3/1942 | Hardie et al. | |
| 2,343,374 | A | | 3/1944 | Hargreaves et al. | |
| 2,617,113 | A | | 11/1952 | Hardie et al. | |
| 2,619,648 | A | | 12/1952 | Hardie et al. | |
| 2,697,465 | A | * | 12/1954 | Johnson | A45C 15/00 2/48 |
| 2,721,331 | A | | 10/1955 | Scheitlin et al. | |
| 2,751,599 | A | | 6/1956 | Peterson et al. | |
| 2,994,091 | A | * | 8/1961 | Aftergood, Jr. | A41F 9/025 112/475.09 |
| 3,040,330 | A | | 6/1962 | Hardie et al. | |
| 3,064,269 | A | | 11/1962 | Scheitlin et al. | |
| 3,414,907 | A | | 12/1968 | Flame et al. | |
| 3,422,461 | A | * | 1/1969 | Froehlich, Jr. | A41F 9/00 2/220 |
| 3,478,366 | A | * | 11/1969 | Kaufman | A41D 27/24 112/419 |
| 3,559,213 | A | | 2/1971 | Goodman | |
| 3,843,973 | A | | 10/1974 | Dillenburger | |
| 3,868,729 | A | | 3/1975 | Lynam et al. | |
| 3,887,968 | A | * | 6/1975 | Lynam | A41F 9/025 24/712 |
| 4,046,087 | A | | 9/1977 | Manetti | |
| 4,583,478 | A | | 4/1986 | Bassetti et al. | |
| 4,606,964 | A | | 8/1986 | Wideman et al. | |
| 4,701,964 | A | | 10/1987 | Prunesti et al. | |
| 4,761,324 | A | | 8/1988 | Rautenberg et al. | |
| 4,935,287 | A | | 6/1990 | Johnson et al. | |
| 5,168,581 | A | | 12/1992 | Garcia et al. | |
| 5,244,716 | A | | 9/1993 | Thornton et al. | |
| 5,375,266 | A | | 12/1994 | Crisco | |
| 5,483,702 | A | | 1/1996 | Ambrosio et al. | |
| 5,576,090 | A | | 11/1996 | Suzuki et al. | |
| 5,675,842 | A | | 10/1997 | Schaefer et al. | |
| 5,683,787 | A | | 11/1997 | Boich et al. | |
| 5,882,769 | A | | 3/1999 | McCormack et al. | |
| 6,205,591 | B1 | * | 3/2001 | Wheeler | A41B 9/08 2/227 |
| 6,286,341 | B2 | | 9/2001 | Jackson, Jr. et al. | |
| 7,181,775 | B2 | | 2/2007 | Carney | |
| 7,676,852 | B1 | | 3/2010 | Carney | |
| 7,834,236 | B2 | | 11/2010 | Middlesworth et al. | |
| 8,555,419 | B2 | | 10/2013 | Demarest et al. | |
| 9,259,039 | B2 | | 2/2016 | Okies et al. | |
| 9,738,999 | B2 | * | 8/2017 | Demarest | A41F 9/00 |
| 2004/0171325 | A1 | | 9/2004 | Woods | |
| 2007/0028364 | A1 | | 2/2007 | Oomae | |
| 2007/0050890 | A1 | * | 3/2007 | Purnell | A41F 9/025 2/235 |
| 2007/0106350 | A1 | | 5/2007 | Carstens | |
| 2007/0106352 | A1 | | 5/2007 | Carstens | |
| 2008/0078012 | A1 | | 4/2008 | Mario | |
| 2009/0038046 | A1 | | 2/2009 | Moore et al. | |

FOREIGN PATENT DOCUMENTS

| | | | |
|---|---|---|---|
| GB | 1041792 | A | 9/1966 |
| GB | 1392199 | A | 4/1975 |
| GB | 2194428 | A | 3/1988 |
| WO | 9534264 | A1 | 12/1995 |
| WO | 200037003 | A2 | 6/2000 |

OTHER PUBLICATIONS

Office Action dated Jan. 17, 2018 in European Patent Application No. 15181176.7, 6 pages.

* cited by examiner

RESILIENT BAND FOR ARTICLE OF APPAREL

CROSS-REFERENCE TO RELATED APPLICATION(S)

This application is a continuation of application Ser. No. 13/965,770, filed Aug. 13, 2013, which is a divisional of U.S. Pat. No. 8,555,419, filed Apr. 30, 2009. The entirety of each being incorporated by reference herein.

FIELD

The present disclosure relates to a flexible, bulk-free, resilient band for an article of apparel, and more particularly, relates to forming the resilient band by joining a first sheet of fabric to a second, more resilient, thin sheet of fabric to form a waistband and the like.

BACKGROUND

Resilient bands, such as waistbands, wristbands, and the like, are commonly used on articles of apparel, such as pants, jackets, and the like, to snugly secure the article of apparel to the wearer.

In general, these bands should snugly cinch the article of apparel to the wearer, but remain flexible enough so as to not limit the wearer's full range of movement or feel too tight by the wearer. In addition, it is often desirable for the band to be as thin as possible so as to prevent the band from feeling bulky by the wearer. For example, waistbands on yoga pants must be particularly flexible and bulk-free, yet still secure the pants to the wearer throughout the wearer's full range of motion.

Known waistbands and the like tend to inadvertently compromise comfort, fit, or the range of motion of the wearer. For example, a commonly used waistband design includes sewing a relatively thick elastic band to a strip of outer fabric to form one or more substantially horizontal seams. While effective as a waistband, this structure tends to feel bulky and not particularly resilient, and it tends to limit the range of motion of the wearer, particularly when used in yoga apparel. Moreover, elastic bands tend to lose some of their elasticity with repeated use over time.

Accordingly, despite the benefits of known resilient band structures used on articles of apparel, there remains a need for a cost effective, durable, light weight, bulk-free resilient band that allows a full range of movement of the wearer without compromising the ability of the band to hold onto its wearer.

SUMMARY

The present invention overcomes these and other shortfalls with the known resilient band structures. A resilient band for use with articles of apparel that is formed with a first fabric operably secured to a more resilient elastic, and preferably fabric, structure is disclosed.

Disclosed preferred embodiment includes the fabric and elastic structure first being placed in a stretched position along their longitudinal lengths. They are then operably secured together with fastening structures that are preferably aligned substantially perpendicular to their longitudinal lengths. The resulting resilient band is extremely flexible and comfortable while still allowing it to effectively grasp the wearer throughout the entire range of movement of the wearer.

This section provides a general summary of the disclosure, and is not a comprehensive disclosure of its full scope or all of its features. Further areas of applicability will become apparent from the description provided herein. The description and specific examples in this summary are intended for purposes of illustration only and are not intended to limit the scope of the present disclosure.

BRIEF DESCRIPTION OF THE DRAWINGS

The drawings described herein are for illustrative purposes only of selected embodiments and not all possible implementations, and are not intended to limit the scope of the present disclosure.

Corresponding reference numerals indicate corresponding parts throughout the several views of the drawings.

DETAILED DESCRIPTION

Figure 5A:
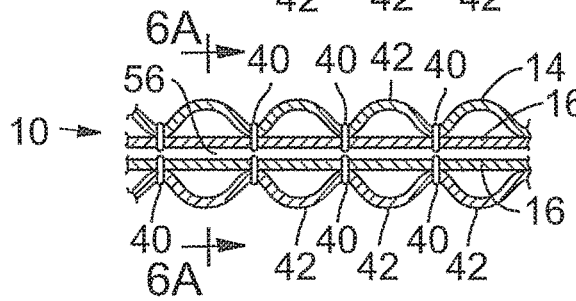
FIG. 5A is a partial, top view of the resilient band of FIG. 2A taken along line 5A-5A of FIG. 2A with the band in a neutral position.
Figure 5B:
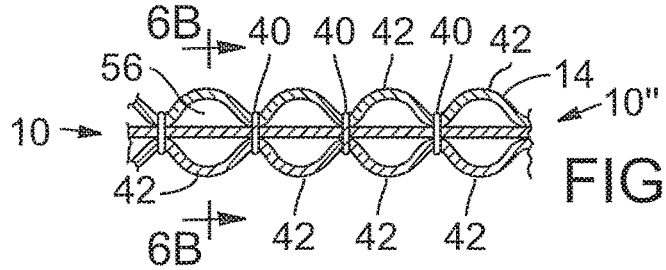
FIG. 5B is a partial, top view of the resilient band of FIG. 2B taken along line 5B-5B of FIG. 2B with the band in a neutral position.
Figure 6A:
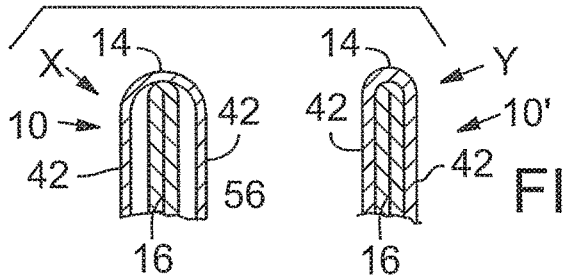
FIG. 6A is a partial cross sectional view of a portion of the band of FIG. 2A showing a possible neutral position X and stretched position Y.
Figure 6B:
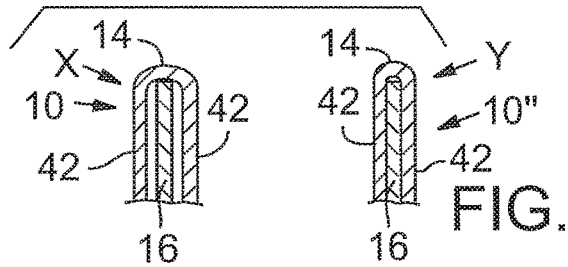
FIG. 6B is a partial cross-sectional view of a portion of the band of FIG. 2B showing a possible neutral position X and stretched position Y.

A resilient band 10 for an article of apparel 12, the band 10 formed with a sheet of first fabric 14 being operably secured to a more resilient sheet of second fabric 16, is shown in FIGS. 1-6B. A first preferred resilient band 10' embodiment is shown in FIGS. 2A, 3, 3A, 3B, 4, 5A and 6A, and a second preferred resilient band embodiment 10" embodiment is shown in FIGS. 2B, 5B, and 6B.

Figure 1:
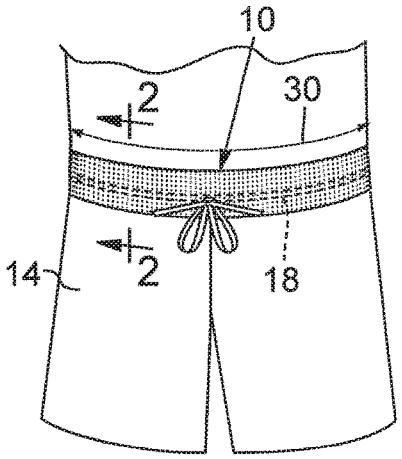
FIG. 1 is a schematic view of an article of apparel having a resilient band in accordance with an embodiment of the present invention.

Referring to FIG. 1, the resilient band 10 is preferably a waistband 10A and the article of apparel 12 is preferably a pair of pants 12A, such as yoga pants. The resilient band 10 is operably secured to the article of apparel 12, and a draw string 18, may be operably received within the resilient band 10 as shown.

Figure 2A:
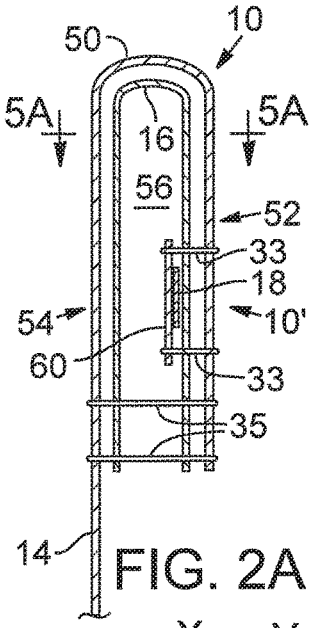
FIG. 2A is an exploded, cross-sectional view of a first embodiment of the resilient band taken along line 2-2 of FIG. 1.
Figure 2B:
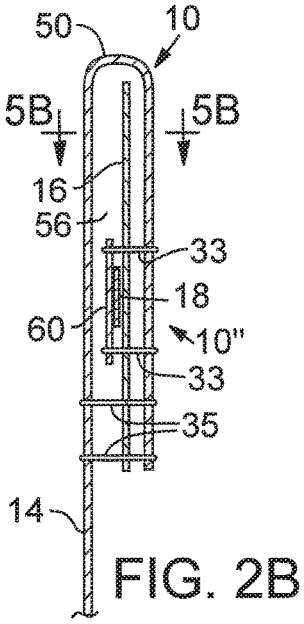
FIG. 2B is an exploded, cross-sectional view of a second embodiment of the resilient band taken along line 2-2 of FIG. 1.

The first fabric 14 is preferably a soft, stretchy fabric, such as fleece or the like, that may also form an outer surface 20 of the article of apparel 12. For example, FIGS. 1, 2A and 2B show the first fabric 14 extending beyond the resilient band 10 to also form the pair of pants 12A.

The second fabric 16 is selected from a group of fabrics that are more resilient than the first fabric 14. It is preferable to encircle the first fabric 14 around the second fabric 16 as best shown in FIGS. 2A and 2B so that the second fabric 16 does not contact the wearer. One known second fabric 16 that has particularly desirable resiliency characteristics is known in the industry as "powermesh," which is a thin, sturdy, breathable, flexible fabric that is preferably stretchable in all directions, but also readily seeks to return to a neutral, unstretched position.

Preferably, the powermesh fabric used as the second fabric 16 is composed of 70 to 90 percent nylon or polyester with the corresponding remaining material comprising spandex. More preferably, the powermesh fabric is warp knit mesh construction formed of 75 to 85 percent nylon or polyester with the remaining material comprising spandex. Even more preferably, the powermesh fabric is formed of less than 20 percent spandex such as 81 percent nylon or polyester and 19 percent spandex.

Other materials having the general elasticity, resiliency, and light fabric weight of powermesh may also be used. These fabric properties are preferably within the following ranges: Fabric weight of 180 grams per meter squared plus or minus 10 percent, and using the stretch recover properties defined by an industry standard test known as ASTM D2594, the resiliency, or "growth properties," of the fabric in the length (wales) direction is preferably equal to a maximum 10 percent, with the width (courses) direction equal to a maximum of 5 percent. The corresponding desired elasticity using a 10 pound stretch property test is preferably between 80 to 100 percent in the length (wales) direction, and between 40 to 60 percent in the width (courses) direction.

The first and second fabrics 14, 16, respectively, are operably secured together so as to not unduly limit the stretchability of the resulting resilient band 10 in all directions. For example, and as shown in FIGS. 3, 3A, 3B and 4, the first and second fabric 14, 16 are placed on top of each other and then urged to a stretched position Y along the longitudinal length 30 of the resulting resilient band 10. The fabrics 14, 16 are secured together while both are in their stretched positions Y and the resulting fabric structure 32 is released to a neutral position X after the two fabrics 14, 16 are secured together.

Figure 3:
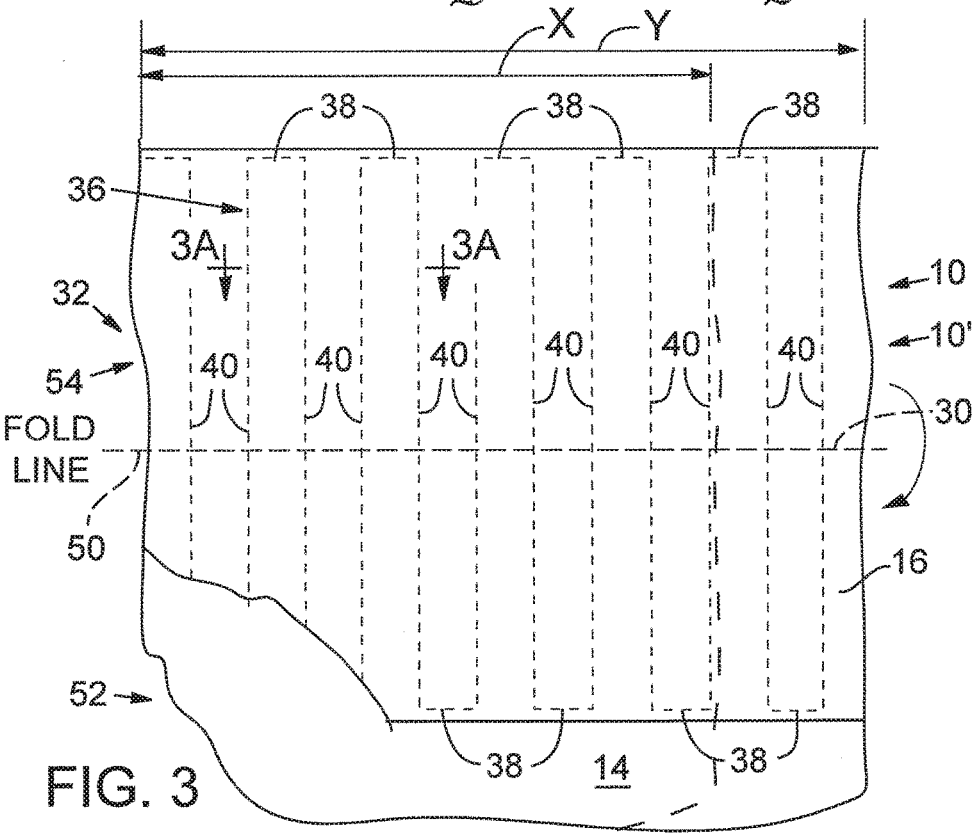
FIG. 3 is a partial, front view of the resilient band of FIG. 2A showing a possible neutral position X and stretched position Y.

Preferably, the first and second fabrics 14, 16 are secured together so as to prevent a substantial continuous seam parallel to the longitudinal length 30 of the resilient band 10. For example, the first and second fabrics 14, 16 may be stitched together with a plurality of spaced-apart, substantially parallelly-aligned stitches 40 that may be aligned substantially vertically and perpendicular to the longitudinal centerline 30 of the resilient band 10 as shown in FIG. 3.

Figure 3A:
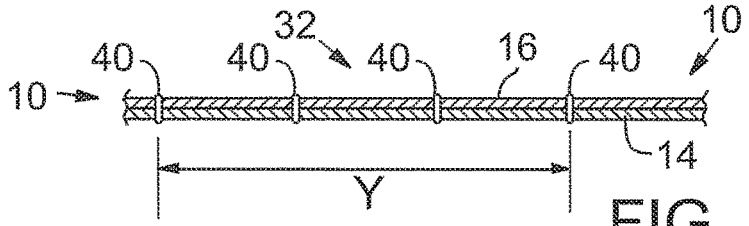
FIG. 3A is a partial, top view of the resilient band of FIG. 3 taken along line 3A-3A of FIG. 3 with the band in the stretched position Y.
Figure 3B:
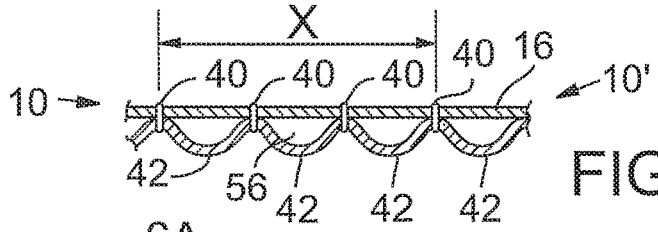
FIG. 3B is a partial, top view of the resilient band of FIG. 2A with the band in the neutral position X.

The resulting stitching pattern will allow the first and second fabrics 14, 16 to rest substantially parallel to each other in the stretched position Y shown in FIG. 3A, but the first fabric 14 will tend to form small, and aesthetically pleasing, curtain-type pleats 42 when the resulting fabric structure 32 is released to its neutral position X as shown in FIG. 3B.

More preferably, the stitching may follow a substantially continuous serpentine pattern 36 along the longitudinal length 30 of the resilient band 10 with cross-over stitching 38 alternating which end to cross-over to the next substantially vertical parallel line 40 of stitching so as to prevent a substantially continuous horizontal seam along the longitudinal length 30 of the resilient band. Even more preferably, the horizontal cross-over stitching 38 extends between two adjacent, substantially vertical and parallel stitching lines 40, with the horizontal cross-over stitching 38 being vertically spaced apart from adjacent cross-over stitching 40 so as to not impede the longitudinal stretching of the resulting resilient band 10, particularly in the direction of the stretched position Y shown in FIG. 4.

Referring to FIGS. 1, 2A, 3, 4, 5A, and 6A a first construction configuration of the resilient band 10' is disclosed. The first and second fabrics 14, 16 are operably secured together as previously described, and the resulting fabric structure 32 is folded over upon itself at fold-line 50 to define a first portion 52 and second portion 54 of the resulting fabric structure 32 and form an internal pocket 56 as best shown in FIG. 2A. The first and second portions 52, 54 are then operably secured together. In the exemplary embodiment of FIG. 2A, for instance, one or more first fastening structures 35 extend transversely through the thickness of resilient band 10' to attach first and second portions 52, 54 together. First fastening structure(s) 35 can, thus extend transversely through first portion 52 and second portion 54 of first fabric 14 and through first portion 52 and second portion 54 of second fabric 16. It will also be appreciated that first fastening structure(s) 35 can be stitching as discussed above.

Figure 4:
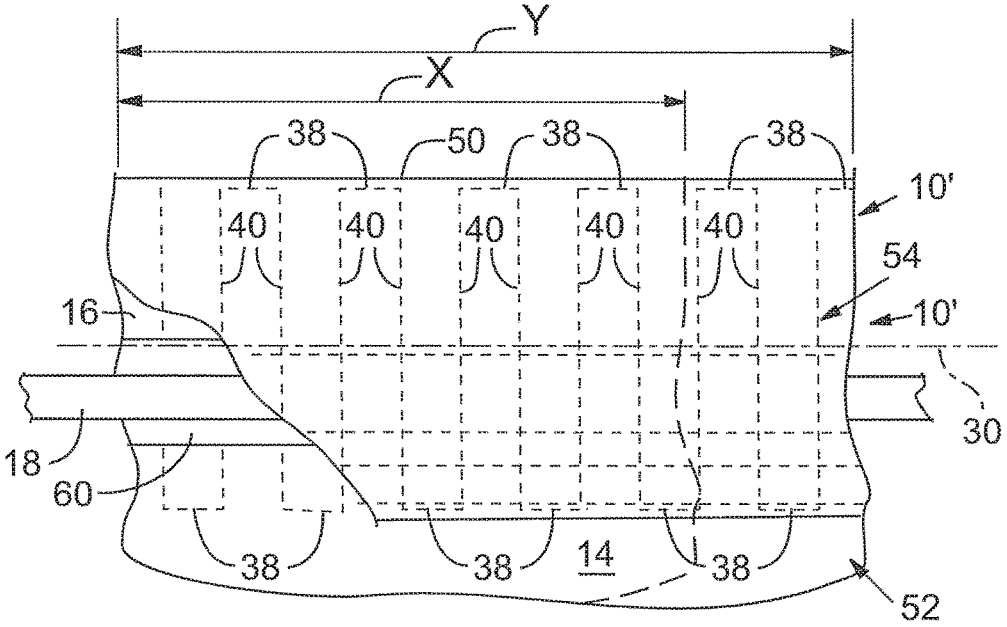
FIG. 4 is a partial, front view of the resilient band of FIG. 2A with a portion broken away to show internal detail.

If desired, the draw string 18 may be operably received in the internal pocket 56 with the ends of the draw string 18 extending through openings 58 (FIG. 1) through an outer wall of the resilient band 10 so as to allow a user to tie the drawstring together. Preferably, a draw string retention panel 60 is operably secured to the fabric structure 32 within the internal pocket 56 so as to maintain proper positioning and alignment of the drawstring within the internal pocket 56 as shown in FIGS. 2A and 4. Specifically, as shown in the exemplary embodiment of FIG. 2A, one or more second fastening structures 33 can extend transversely through the thickness of band 10' to attach first portion 52 of first fabric 14, first portion 52 of second fabric 16, and draw string retention panel 60. It is also noted that second fastening structure(s) 33 can terminate inside pocket 56 in the transverse direction to stop short of extending through second portion 54 of first and second fabrics 14, 16. Moreover, it will be appreciated that second fastening structure(s) 33 can be stitching as discussed above.

Referring to exemplary embodiments of FIGS. 2B, 5B and 6B, an alternative resilient band 10" construction configuration is disclosed. The first fabric 14 is operably secured to a thin strip of second fabric 16 to form a resulting fabric structure 32 as previously described. Then, the resulting fabric structure 32 is folded over the first fabric 14 as best shown in FIG. 2B so as to allow the first fabric 14 to encircle the inner second fabric 16 and define an internal pocket 56. This construction configuration results in a single layer of inner second fabric 16, and therefore a thinner resilient band 10". Also, first fastening structures 35 can attach first fabric 14 and second fabric 16, and second fastening structures 33 can attach first fabric 14, second fabric 16, and draw string retention panel 60, similar to the embodiments discussed above.

If desired, the draw string 18 may be operably received within the internal pocket 56 of this configuration as previously shown and described.

The resulting resilient band 10 is bulk free and easily flexible in all directions, including along the longitudinal length 30 of the band, while still offering superior holding ability through the entire range of motion of the wearer.

The foregoing description of the embodiments has been provided for purposes of illustration and description. It is not intended to be exhaustive or to limit the invention. For example, although the disclosed first fabric 14 is described as also serving as the fabric for forming the article of apparel 16, the resilient band 10 of the present invention may be a discrete structure that is separate from the article of apparel 12 to which it is attached. Similarly, the article of apparel may not be a pair of paints, but a jacket or the like with the resilient band forming a wrist-strap, waist strap or the like thereon.

Also, the stitching methods and structures for securing the two fabrics 14, 16 together are for exemplary purposes only. Other securing methods, such as heating, using adhesives, and the like may also be used so long as the resulting securing structures do not unduly limit the range of movement of the resulting resilient band 10 as described. In addition, the disclosed parallelly-aligned patterns for securing the two fabrics 14, 16 together need not form straight lines nor be aligned substantially perpendicular to the longitudinal length 30 of the resilient band 10.

Similarly, individual elements or features of a particular embodiment are generally not limited to that particular embodiment, but, where applicable, are interchangeable and can be used in a selected embodiment, even if not specifically shown or described. The same may also be varied in many ways. Such variations are not to be regarded as a departure from the invention, and all such modifications are intended to be included within the scope of the invention.

What is claimed is:

1. A resilient band for an article of apparel, the resilient band having a longitudinal length and a cross section taken in a direction transverse to the longitudinal length, the resilient band comprising:

a first resilient fabric in the cross section, having a first resiliency and folded over upon itself at a fold to define—a first portion, a second portion that overlaps the first portion, and a pocket between the first and second portions, wherein the pocket is closed off at the fold and open at an end that is opposite the fold;

a second resilient fabric in the cross section, disposed within the pocket and having a second resiliency greater than the first resiliency; and a plurality of fastening structures extending in the transverse direction through the first resilient fabric and the second resilient fabric to secure the first resilient fabric and the second resilient fabric together, and terminating inside the pocket to stop short of extending through the second portion of the first resilient fabric.

2. The resilient band of claim 1, wherein the resilient band defines a waist strap for the article of apparel.

3. The resilient band of claim 2, wherein the first resilient fabric defines the article of apparel.

4. The resilient band of claim 1, wherein the first resilient fabric and the second resilient fabric are secured together when the first resilient fabric and the second resilient fabric are in a stretched state, such that the first resilient fabric presents a plurality of pleats when the secured first and second resilient fabrics are in a neutral state.

5. The resilient band of claim 1, wherein the article of apparel is a jacket.

6. The resilient band of claim 1, wherein the second resilient fabric comprises at least one of powermesh, spandex, and nylon.

7. The resilient band of claim 1, wherein a fastening structure in the plurality of fastening structures extends in the transverse direction.

8. The resilient band of claim 7, wherein the fastening structure in the plurality of fastening structures is spaced-apart from, and laterally-aligned with, at least another fastening structure in the plurality of fastening structures.

9. The resilient band of claim 1, wherein the plurality of fastening structures includes stitching.

10. The resilient band of claim 9, wherein the stitching extends in a substantially serpentine pattern.

11. A resilient band for an article of apparel, the resilient band having a longitudinal length and a cross section taken in a direction transverse to the longitudinal length, the resilient band comprising:

a first resilient fabric in the cross section, having a first resiliency and folded over upon itself at a fold to define—a first portion, a second portion that overlaps the first portion, and a pocket between the first and second portions, wherein the pocket is closed off at the fold;

a second resilient fabric in the cross section, disposed within the pocket and having a second resiliency greater than the first resiliency; and a plurality of spaced-apart fastening structures that extend in the transverse direction through the first resilient fabric and the second resilient fabric to secure the first resilient fabric and the second resilient fabric together, and terminating inside the pocket to stop short of extending through the second portion of the first resilient fabric.

12. The resilient band of claim 11, wherein the resilient band defines a waist strap for the article of apparel.

13. The resilient band of claim 12, wherein the first resilient fabric defines the article of apparel.

14. The resilient band of claim 13, wherein the article of apparel is a jacket.

15. The resilient band of claim 11, wherein the first resilient fabric presents a plurality of pleats, and wherein a pleat in the plurality of pleats is defined by an adjacent pair of spaced-apart fastening structures in the plurality of spaced-apart fastening structures.

16. The resilient band of claim 11, wherein the second resilient fabric comprises at least one of powermesh, spandex, and nylon.

17. The resilient band of claim 11, wherein a fastening structure in the plurality of fastening structures is laterally-aligned with at least another fastening structure in the plurality of fastening structures.

18. The resilient band of claim 17, wherein the fastening structure in the plurality of fastening structures includes stitching.

19. The resilient band of claim 18, wherein the stitching extends in a substantially serpentine pattern.

20. The resilient band of claim 11, wherein the pocket is open at an end that is opposite the fold.

* * * * *